US009291308B2

(12) United States Patent
Ezzarhouni et al.

(10) Patent No.: US 9,291,308 B2
(45) Date of Patent: Mar. 22, 2016

(54) LNG CONTAINER WITH A CONNECTING DEVICE WHICH CONNECTS A SECONDARY IMPERMEABLE BARRIER TO A LOAD BEARING STRUCTURE

(75) Inventors: Adnan Ezzarhouni, Guyancourt (FR); Lucas Troncy, Antony (FR)

(73) Assignee: GAZTRANSPORT & TECHNIGAZ, Saint Remy les Chevreuse (FR)

( * ) Notice: Subject to any disclaimer, the term of this patent is extended or adjusted under 35 U.S.C. 154(b) by 537 days.

(21) Appl. No.: 13/258,740

(22) PCT Filed: Mar. 11, 2010

(86) PCT No.: PCT/FR2010/050417

§ 371 (c)(1),
(2), (4) Date: Sep. 22, 2011

(87) PCT Pub. No.: WO2010/119199

PCT Pub. Date: Oct. 21, 2010

(65) Prior Publication Data

US 2012/0012473 A1 Jan. 19, 2012

(30) Foreign Application Priority Data

Apr. 14, 2009 (FR) ..... 09 52425

(51) Int. Cl.
*B65B 3/00* (2006.01)
*F17C 3/02* (2006.01)

(52) U.S. Cl.
CPC ..... *F17C 3/027* (2013.01); *F17C 3/022* (2013.01); *F17C 2201/0147* (2013.01); *F17C 2201/052* (2013.01); *F17C 2203/0304* (2013.01); *F17C 2203/0629* (2013.01); *F17C 2209/227* (2013.01); *F17C 2209/228* (2013.01);

(Continued)

(58) Field of Classification Search
CPC ..... F17C 3/022; F17C 3/027
USPC ..... 114/74 A; 220/560.04–560.15, 901
See application file for complete search history.

(56) References Cited

U.S. PATENT DOCUMENTS 2,911,125 A * 11/1959 Dosker ..... 220/560.05
2,983,401 A * 5/1961 Murphy ..... 220/560.05

(Continued)

FOREIGN PATENT DOCUMENTS

FR 1293237 5/1962
FR 2691520 A1 11/1993

(Continued)

*Primary Examiner* — King M Chu
(74) *Attorney, Agent, or Firm* — Birch, Stewart, Kolasch & Birch, LLP

(57) ABSTRACT

A liquefied natural gas container including a loadbearing structure and an impermeable and thermally insulated tank designed to contain liquefied natural gas. Each tank wall having in succession, in a direction of a thickness, proceeding from an inside of the tank to an outside, a primary impermeable barrier, a primary thermally insulating barrier, a secondary impermeable barrier, and a secondary thermally insulating barrier. The secondary impermeable barrier of a vertical wall includes a first impermeable sheet at the top of the wall and a connecting device which impermeably connects the first impermeable sheet to the loadbearing structure. The connecting device includes a first metal plate parallel to the first impermeable sheet, and a second impermeable sheet which is on the one hand bonded to the first impermeable sheet, and on the other hand connected to the first metal plate.

20 Claims, 7 Drawing Sheets

(52) U.S. Cl.
CPC .... *F17C 2209/232* (2013.01); *F17C 2209/234* (2013.01); *F17C 2221/033* (2013.01); *F17C 2223/0161* (2013.01); *F17C 2223/033* (2013.01); *F17C 2260/013* (2013.01); *F17C 2270/0107* (2013.01); *F17C 2270/0136* (2013.01)

(56) References Cited

U.S. PATENT DOCUMENTS

| | | | | | |
|---|---|---|---|---|---|
| 3,026,577 | A | * | 3/1962 | Dosker | 52/506.05 |
| 3,062,507 | A | * | 11/1962 | Andrus | 165/185 |
| 3,064,612 | A | * | 11/1962 | Gardner et al. | 114/74 A |
| 3,092,933 | A | * | 6/1963 | Closner et al. | 52/223.2 |
| 3,158,459 | A | * | 11/1964 | Guilhem | 62/45.1 |
| 3,206,057 | A | * | 9/1965 | Prew | 220/560.03 |
| 3,267,685 | A | * | 8/1966 | Schroeder | 62/45.1 |
| 3,298,345 | A | * | 1/1967 | Pratt | 114/74 A |
| 3,319,431 | A | | 5/1967 | Clarke et al. | |
| 3,339,783 | A | * | 9/1967 | Gorman | 220/560.11 |
| 3,341,050 | A | * | 9/1967 | Forman et al. | 220/560.12 |
| 3,341,051 | A | * | 9/1967 | Forman et al. | 220/560.15 |
| 3,361,285 | A | * | 1/1968 | Alleaume | 220/592.2 |
| 3,367,492 | A | * | 2/1968 | Pratt et al. | 220/560.07 |
| 3,379,330 | A | * | 4/1968 | Perkins, Jr. | 220/560.13 |
| 3,403,651 | A | * | 10/1968 | Auguste | 114/74 A |
| 3,471,983 | A | * | 10/1969 | Alleaume | 52/276 |
| 3,481,504 | A | * | 12/1969 | Nelson | 220/560.05 |
| 3,490,639 | A | * | 1/1970 | Merriman | 220/560.05 |
| 3,562,986 | A | * | 2/1971 | Nelson et al. | 52/246 |
| 3,570,700 | A | | 3/1971 | Yamamoto et al. | |
| 3,583,592 | A | * | 6/1971 | Kerfman | 220/560.12 |
| 3,595,424 | A | * | 7/1971 | Jackson | 220/562 |
| 3,633,328 | A | * | 1/1972 | Closner et al. | 52/223.2 |
| 3,651,648 | A | * | 3/1972 | Hamilton | 405/53 |
| 3,670,917 | A | * | 6/1972 | Nishimaki et al. | 220/560.15 |
| 3,671,315 | A | * | 6/1972 | Iarossi | 114/74 A |
| 3,682,346 | A | * | 8/1972 | Sterrett | 220/562 |
| 3,753,848 | A | * | 8/1973 | Bennett | 428/179 |
| 3,754,675 | A | * | 8/1973 | Richard et al. | 220/560.06 |
| 3,759,209 | A | * | 9/1973 | Iarossi et al. | 114/74 A |
| 3,782,053 | A | * | 1/1974 | Nakano et al. | 52/417 |
| 3,785,320 | A | * | 1/1974 | Bourgeois et al. | 114/74 A |
| 3,800,970 | A | * | 4/1974 | Jackson | 220/560.08 |
| 3,804,050 | A | * | 4/1974 | Iarossi | 114/74 A |
| 3,811,593 | A | * | 5/1974 | Bridges et al. | 220/560.07 |
| 3,826,399 | A | * | 7/1974 | Noma et al. | 220/586 |
| 3,839,981 | A | * | 10/1974 | Gilles | 114/74 A |
| 3,851,611 | A | * | 12/1974 | Yamamoto | 114/74 A |
| 3,852,973 | A | * | 12/1974 | Marothy | 62/45.1 |
| 3,855,811 | A | * | 12/1974 | Sauerbrunn et al. | 62/45.1 |
| 3,862,700 | A | * | 1/1975 | Noma et al. | 220/560.05 |
| 3,882,809 | A | * | 5/1975 | Johnson et al. | 114/74 A |
| 3,894,372 | A | * | 7/1975 | Roberts et al. | 220/560.06 |
| 3,896,961 | A | * | 7/1975 | Guilhem et al. | 220/560.15 |
| 3,931,424 | A | * | 1/1976 | Helf et al. | 428/33 |
| 3,948,198 | A | * | 4/1976 | Yamamoto et al. | 114/74 A |
| 3,998,350 | A | * | 12/1976 | Massac | 220/565 |
| 4,004,706 | A | * | 1/1977 | Guldenfels et al. | 220/586 |
| 4,032,608 | A | * | 6/1977 | Zinniger et al. | 264/46.6 |
| 4,116,150 | A | * | 9/1978 | McCown | 114/74 A |
| 4,117,947 | A | * | 10/1978 | Androulakis | 220/560.08 |
| 4,123,582 | A | * | 10/1978 | Musyt | 428/335 |
| 4,394,931 | A | * | 7/1983 | Cotgreave et al. | 220/560.11 |
| 4,452,162 | A | * | 6/1984 | Harbaugh | 114/74 A |
| 4,552,281 | A | * | 11/1985 | Schneider | 220/4.13 |
| 4,562,934 | A | * | 1/1986 | Hammond | 220/685 |
| 4,651,401 | A | * | 3/1987 | Arbella | 29/429 |
| 5,169,697 | A | * | 12/1992 | Langley et al. | 428/57 |
| 5,501,359 | A | | 3/1996 | Chauvin et al. | |
| 5,586,513 | A | | 12/1996 | Jean et al. | |
| 6,009,821 | A | * | 1/2000 | Al-Rammah et al. | 114/65 A |
| 6,035,795 | A | * | 3/2000 | Dhellemmes et al. | 114/74 A |
| 6,076,313 | A | * | 6/2000 | Pannell et al. | 52/169.6 |
| 6,374,761 | B1 | * | 4/2002 | Dhellemmes | 114/74 A |
| 6,467,643 | B1 | * | 10/2002 | Sadr | 220/562 |
| 6,637,359 | B1 | * | 10/2003 | Hagner | B63B 9/04 114/65 R |
| 6,682,259 | B1 | * | 1/2004 | Thomas et al. | 404/71 |
| 6,982,105 | B2 | * | 1/2006 | Huse | 428/34.5 |
| 7,105,121 | B2 | * | 9/2006 | Sadr | 264/266 |
| 7,171,916 | B2 | * | 2/2007 | Yang et al. | 114/74 A |
| 7,204,195 | B2 | * | 4/2007 | Yang | B63B 25/14 114/74 A |
| 7,211,307 | B2 | * | 5/2007 | Potter | B60K 15/03177 220/4.14 |
| 7,464,658 | B2 | * | 12/2008 | Dhellemmes et al. | 114/74 A |
| 7,555,991 | B2 | * | 7/2009 | Dhellemmes et al. | 114/74 A |
| 7,584,864 | B2 | * | 9/2009 | Yamamoto et al. | 220/4.13 |
| 7,597,212 | B2 | * | 10/2009 | Yang et al. | 220/560.07 |
| 7,717,288 | B2 | * | 5/2010 | Yang et al. | 220/560.05 |
| 7,717,289 | B2 | * | 5/2010 | Yang et al. | 220/560.07 |
| 7,900,794 | B2 | * | 3/2011 | Dhellemmes et al. | 220/560.05 |
| 7,938,287 | B2 | * | 5/2011 | Yang et al. | 220/560.07 |
| 8,317,056 | B2 | | 11/2012 | Lee et al. | |
| 8,381,928 | B2 | * | 2/2013 | Burrington et al. | 220/4.14 |
| 2001/0045433 | A1 | * | 11/2001 | Ellis | 220/562 |
| 2006/0086741 | A1 | * | 4/2006 | Bacon et al. | 220/560.12 |
| 2007/0286974 | A1 | * | 12/2007 | Sholler et al. | 428/35.7 |
| 2008/0011756 | A1 | * | 1/2008 | Lee et al. | 220/560.13 |
| 2008/0053993 | A1 | * | 3/2008 | Yang et al. | 220/4.12 |
| 2008/0302804 | A1 | * | 12/2008 | Simmons et al. | 220/560.05 |
| 2010/0018225 | A1 | * | 1/2010 | Yang et al. | 62/53.2 |
| 2012/0012473 | A1 | * | 1/2012 | Ezzarhouni | F17C 3/022 206/0.6 |
| 2012/0168445 | A1 | * | 7/2012 | Ezzarhouni | F17C 3/022 220/560.05 |
| 2013/0255562 | A1 | * | 10/2013 | Canler et al. | 114/74 A |

FOREIGN PATENT DOCUMENTS

| | | | | | |
|---|---|---|---|---|---|
| FR | 2724623 | A1 | | 3/1996 | |
| FR | 2739675 | A1 | | 4/1997 | |
| GB | 1184440 | | | 3/1970 | |
| JP | 08207883 | A | * | 8/1996 | B63B 25/16 |
| KR | 10-0760482 | | | 9/2007 | |

* cited by examiner

LNG CONTAINER WITH A CONNECTING DEVICE WHICH CONNECTS A SECONDARY IMPERMEABLE BARRIER TO A LOAD BEARING STRUCTURE

This application is the National Phase of PCT International Application No. PCT/FR2010/050417 filed on Mar. 11, 2010, which claims priority under 35 U.S.C. 119(a) to Patent Application No. 0952425, filed in France on Apr. 14, 2009, all of which are hereby expressly incorporated by reference into the present application.

TECHNICAL FIELD OF THE INVENTION

The present invention relates to the making of impermeable and thermally insulated tanks built into a loadbearing structure.

PRIOR ART

French patent applications No. FR 2 691 520 and No. FR 2 724 623 have already proposed an impermeable and thermally insulated tank built into a loadbearing structure formed by the double hull of a ship. Each wall of the tank has, in succession, proceeding from the inside of the tank to the loadbearing structure, a primary impermeable barrier in contact with the product contained in the tank, a primary thermally insulating barrier, a secondary impermeable barrier and a secondary thermally insulating barrier.

The primary thermally insulating barrier, the secondary impermeable barrier and the secondary thermally insulating barrier are essentially made up of multiple prefabricated panels fixed to the loadbearing structure. Each prefabricated panel is formed of: firstly, a first rigid plate carrying a layer of thermal insulation with which it forms a secondary thermally insulating barrier element; secondly, a flexible or rigid sheet stuck essentially to the whole of the surface of the thermal insulation layer of the aforementioned secondary thermally insulating barrier element, said sheet forming a secondary impermeable barrier element; thirdly, a second thermal insulation layer which partly covers the aforementioned sheet and sticks to it; and, fourthly, a second rigid plate covering the second thermal insulation layer with which it forms a primary thermally insulating barrier element.

In a zone at the top of the vertical walls of the tank, the secondary impermeable In a zone at the top of the vertical walls of the tank, the secondary impermeable barrier is connected to the loadbearing structure. This zone, known as the "termination zone of the secondary membrane", is not described in the aforementioned documents.

FIG. 1 shows a cross section through the termination zone of the secondary membrane of a prior art tank. The loadbearing structure 1 is formed by the double hull of a ship. It comprises a vertical section 2 and a horizontal section 3. An L-shaped flat 4 is welded to the horizontal section 3 and extends downwards.

In a known manner, prefabricated panels (not shown) are fixed to the vertical section 2 to form the primary thermally insulating barrier, the secondary impermeable barrier and the secondary thermally insulating barrier. FIG. 1 shows the layer 5 of insulating material and the impermeable sheet 6 of the uppermost prefabricated panel.

In the termination zone of the secondary membrane, the sheet 6 must be connected impermeably to the loadbearing structure 1. This is done by using a flexible sheet 7 which is bonded on the one hand to the sheet 6 of the prefabricated panel, and on the other hand to the L-shaped flat 4. The sheet 7 is bonded to the L-shaped flat 4, and two layers of mastic 8 are provided, in the manner shown in more detail in FIG. 2. A compression beam 9 is bolted to the L-shaped flat 4.

This system of closing the secondary membrane has several disadvantages.

In the first place, the mechanical join between the sheet 7 and the L-shaped flat 4 is complicated to prepare because it requires not only bonding the sheet 7 but also applying two layers of mastic 8 and bolting down the beam 9.

In the second place, the limited surface area bonded between the sheet 7 and the L-shaped flat 4 requires the use of highly trained and experienced labour to carry out all the steps correctly and ensure there can be no leaks of LNG in either gaseous or liquid form.

SUMMARY OF THE INVENTION

One problem which the present invention seeks to solve is the provision of a tank that avoids at least some of the disadvantages of the prior art mentioned above. In particular, it is an object of the invention to provide a tank in which the secondary impermeable barrier can be connected more easily to the loadbearing structure. It is another object of the invention to maximize the possibility of automating the manufacture of the tank and make it as reliable as possible.

The solution proposed by the invention is a liquefied natural gas container comprising a loadbearing structure and an impermeable and thermally insulated tank designed to contain liquefied natural gas, said tank comprising a plurality of tank walls fixed to said loadbearing structure, each tank wall having in succession, in the direction of the thickness, proceeding from the inside of said tank to the outside, a primary impermeable barrier, a primary thermally insulating barrier, a secondary impermeable barrier and a secondary thermally insulating barrier, said tank walls comprising at least one vertical wall, the secondary impermeable barrier of said vertical wall comprising a first impermeable sheet at the top of said wall and a connecting device which impermeably connects said first impermeable sheet to said loadbearing structure, said container being characterized in that said connecting device comprises a first metal plate parallel to said first impermeable sheet, a third impermeable sheet bonded to said first metal plate, and a second impermeable sheet which is bonded on the one hand to said first impermeable sheet and on the other hand to said third impermeable sheet. As a variant, the second impermeable sheet may be bonded directly to the first metal plate.

This container may be for example a ship or a land-based container. Given the abovementioned features, the second impermeable sheet is bonded to each of two parallel surfaces. This bonding can therefore be done easily in an automated and reliable manner. The first impermeable sheet can be bonded before installation in the tank, in the workshop. The first plate is metallic, so it can be connected to the loadbearing structure, directly or indirectly, by continuous welding. This continuous welding can also be done easily in an automated and reliable manner. The invention thus makes it possible to dispense with the use of layers of mastic. In addition, the bonding of the second sheet does not require highly trained and experienced labour.

For preference, said second impermeable sheet is flexible and has an unbonded zone between the first impermeable sheet and the third impermeable sheet.

Because of the flexibility of the second sheet and because of the unbonded zone, movements imposed by the loadbearing structure and the secondary thermal insulation are absorbed by the secondary impermeable barrier.

Advantageously, said first metal plate is welded to a metal component connected to the loadbearing structure.

For preference, said metal component has a vertical part and a horizontal part, the first metal plate being welded to the vertical part and the horizontal part being connected to the loadbearing structure.

The length of the horizontal part allows the position of the vertical part to be adjusted during installation of the metal component. This allows the position of the vertical part to be adjusted to suit the position of the first sheet. In one embodiment the vertical part, to which the third impermeable sheet is bonded, is positioned in such a way that the first and third sheets are situated in the same plane. This further simplifies bonding.

Advantageously, said first impermeable sheet is bonded to a layer of insulating material or to a plate of plywood forming part of the secondary thermally insulating barrier.

In one embodiment, said loadbearing structure comprises vertical concrete wall sections installed on land.

In another embodiment, said loadbearing structure comprises the double hull of a floating vessel.

BRIEF DESCRIPTION OF THE FIGURES

The invention will be understood more clearly, and other objects, details, features and advantages thereof will become more clearly apparent in the course of the following description of various particular embodiments of the invention, given purely by way of illustration and without implying any limitation, with reference to the appended drawings. In these drawings.

DETAILED DESCRIPTION OF EMBODIMENTS OF THE INVENTION

Figure 14:
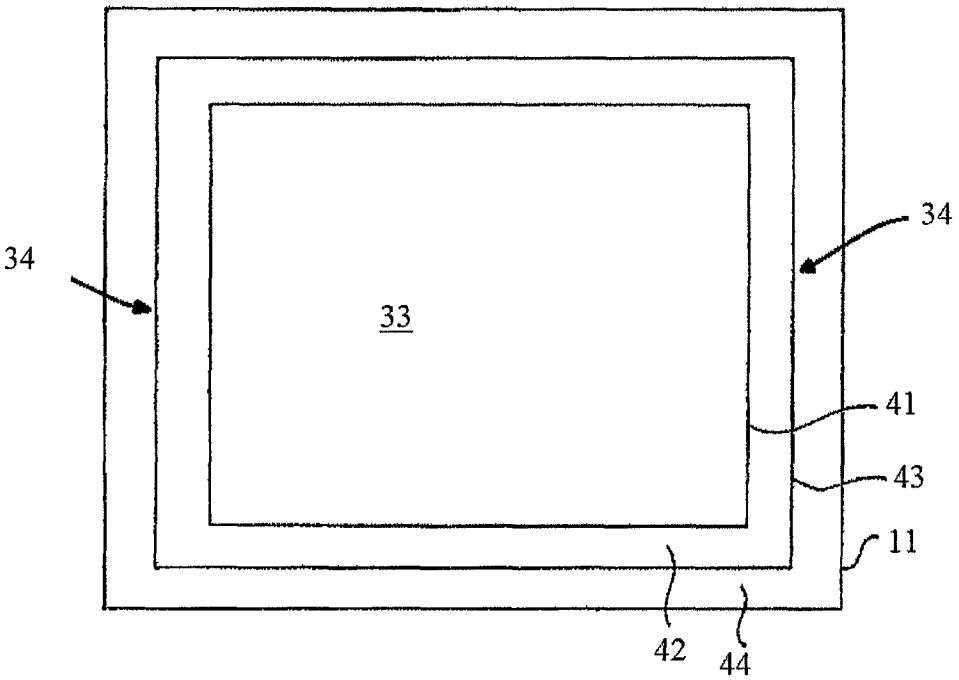
FIG. 14 is a schematic sectional view of the tank.

FIGS. 3 to 9 relate to a tank in a first embodiment of the invention. The tank 33 has several tank walls 34 and is built into a loadbearing structure 11. The loadbearing structure 11 may be the double hull of a ship or other kind of floating vessel. The elements of tank 33 can be seen in the schematic sectional view of tank 33 in FIG. 14.

As in the prior art, each tank wall 34 has in succession, proceeding in the direction of the thickness from the inside of the tank 33 to the outside, a primary impermeable barrier 41, a primary thermally insulating barrier 42, a secondary impermeable barrier 43, and a secondary thermally insulating barrier 44.

Much as in the prior art identified in the introduction, the primary thermally insulating barrier 42, the secondary impermeable barrier 43 and the secondary thermally insulating barrier 44 consist essentially of multiple prefabricated panels fixed to the loadbearing structure 11.

Specifically, the secondary impermeable barrier 43 consists of an assembly of impermeable sheets. Each sheet consists of a composite material whose two outer layers are fibreglass cloths and whose intermediate layer is a thin deformable aluminium foil approximately 0.1 mm thick. Depending on how it is made, the sheet may be rigid or flexible. Each prefabricated panel therefore comprises, in part, a rigid sheet bonded to a layer of thermally insulating material. At the joins between adjacent panels, strips of flexible sheet connect adjacent rigid sheets.

Figure 3:
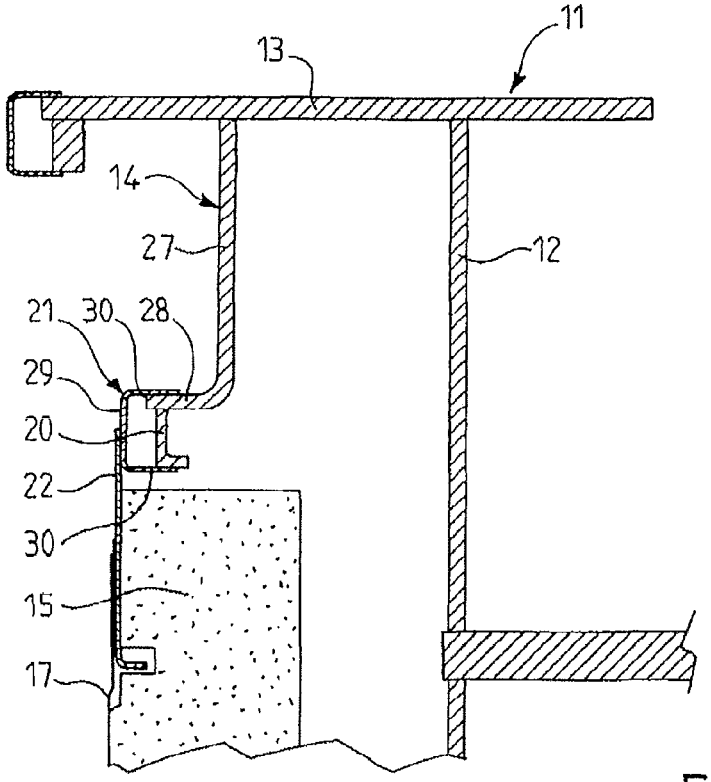
FIG. 3 is a cross section through a tank in one embodiment of the invention, at the termination zone of the secondary membrane.
Figure 4:
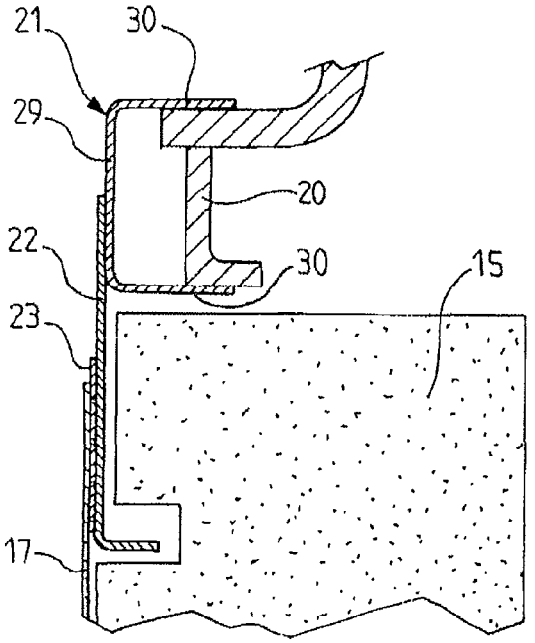
FIGS. 4 and 5 show details from FIG. 3.
Figure 5:
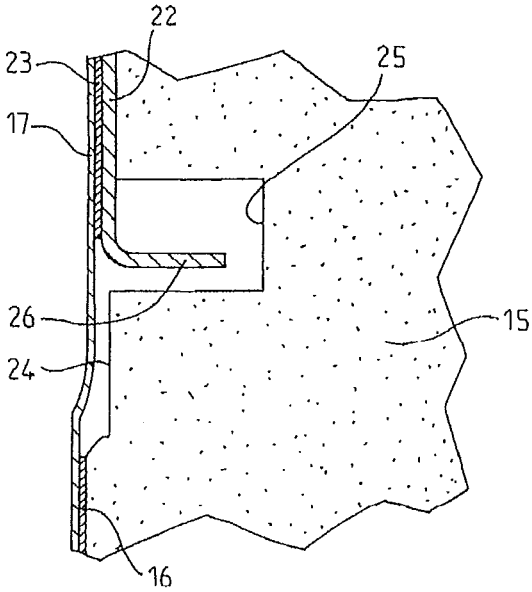

In a zone at the top of a vertical wall of the tank 33, the secondary impermeable barrier 43, also known as the secondary membrane, is connected to the loadbearing structure 11. FIG. 3 shows, in cross section, this zone known as the termination zone of the secondary membrane. FIGS. 4 and 5 show details from FIG. 3.

The loadbearing structure 11 comprises a vertical section 12 and a horizontal section 13. An L-shaped flat 14 is welded to the horizontal section 13. The flat 14 has a vertical part 27 that extends down, parallel to the vertical section 12, and a horizontal part 28 situated at the lower end of the vertical part 27 and extending at a distance from the vertical section 12.

A fixing bracket 20 is fixed under the horizontal part 28. A U-shaped stirrup 21 is fixed to the flat 14 and to the bracket 20. More specifically, the stirrup 21 has two parallel arms 30 connected by a wall 29 perpendicular to the arms 30. The arms 30 are fixed, one to the horizontal part 28 of the flat 14, and one to the bracket 20.

Figure 1:
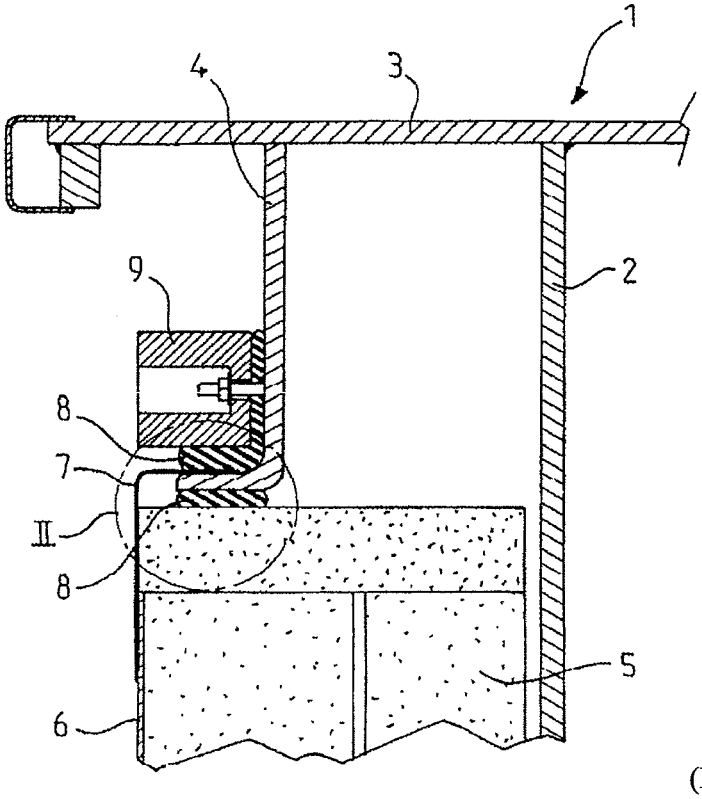
FIG.1 (Prior Art )
FIG. 1 is a cross section through a prior art tank at the termination zone of the secondary membrane.
Figure 2:
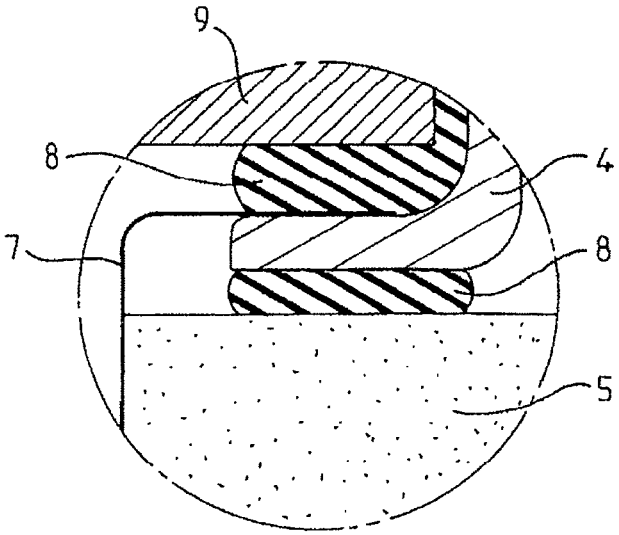
FIG.2 (Prior Art )
FIG. 2 shows a detail from FIG. 1.

It may be observed, firstly, that the loadbearing structure 11 and the flat 14 are the same shape as in the prior art shown in FIG. 1. In other words, the invention does not necessitate changing the shapes of commonly used loadbearing structures. Secondly, the bracket 20 and the stirrup 21 can be fixed easily in an automated and reliable manner by continuous welding.

In FIGS. 3 to 5 a layer 15 of thermally insulating material belonging to a prefabricated panel at the top of the wall is visible. This layer 15 is covered by a rigid sheet 16, except at an upper edge. At this upper edge the layer 15 is thinner and the panel has a recessed face 24 containing a horizontal groove 25. The face 24 is approximately in the same plane as the wall 29 of the stirrup 21, which is possible because the geometry of the stirrup 21 is such that, during its fixing, the position of the wall 29 can be adjusted.

A metal plate 22 is welded to the wall 29 of the stirrup and extends down, covering the face 24 as far as the groove 25. At its lower extremity the plate 22 has a lip 26 which is bent into the groove 25. A strip of rigid sheet 23 is bonded to the plate 22.

As FIG. 5 shows, a strip of flexible sheet 17 is bonded both to the sheet 16 and to the sheet 23. Between the sheets 16 and 23 is an unbonded zone. It can be seen that this bonding is performed on two parallel surfaces on which there are rigid sheets. This bonding can therefore be done easily, in an automated and reliable manner. In a variant, there is no strip of sheet 23 and the strip of sheet 17 is bonded directly to the plate 22.

The foregoing structure enables the sheet 16 of the prefabricated panel to be connected impermeably to the loadbearing structure 11 by means of the flexible sheet 17, optionally the rigid sheet 23, the plate 22, the stirrup 21, and the flat 14. Moreover, the flexibility of the sheet 17 allows movements of the loadbearing structure 11 and the secondary thermal insulation to be absorbed by the secondary impermeable barrier 43, leaving an unbonded zone between the sheet 23 and the sheet 16.

Figure 6:
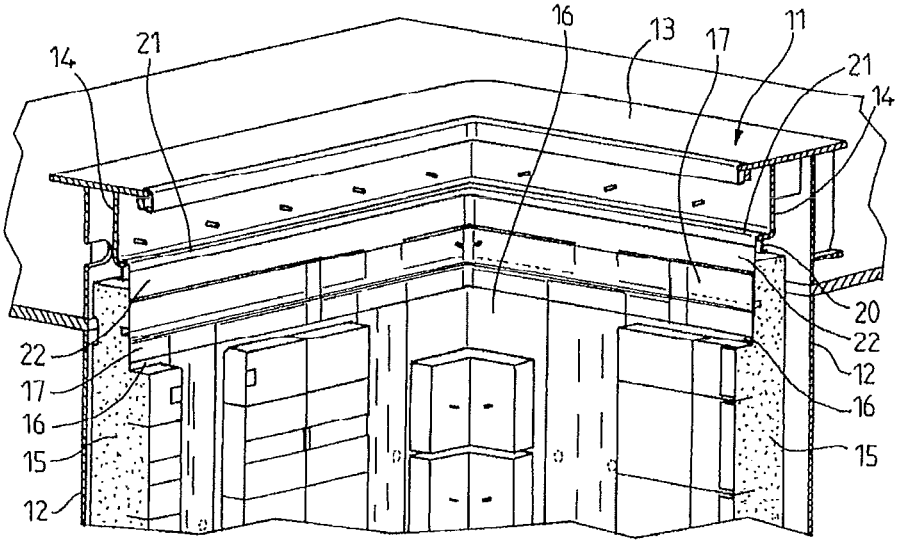
FIG. 6 is a perspective view of the termination zone of the secondary tank membrane shown in FIG. 3, at a corner.

FIG. 6 is a perspective view of a corner of the tank 33 formed by two vertical walls. In each wall, certain of the components described above can be seen.

Figure 7:
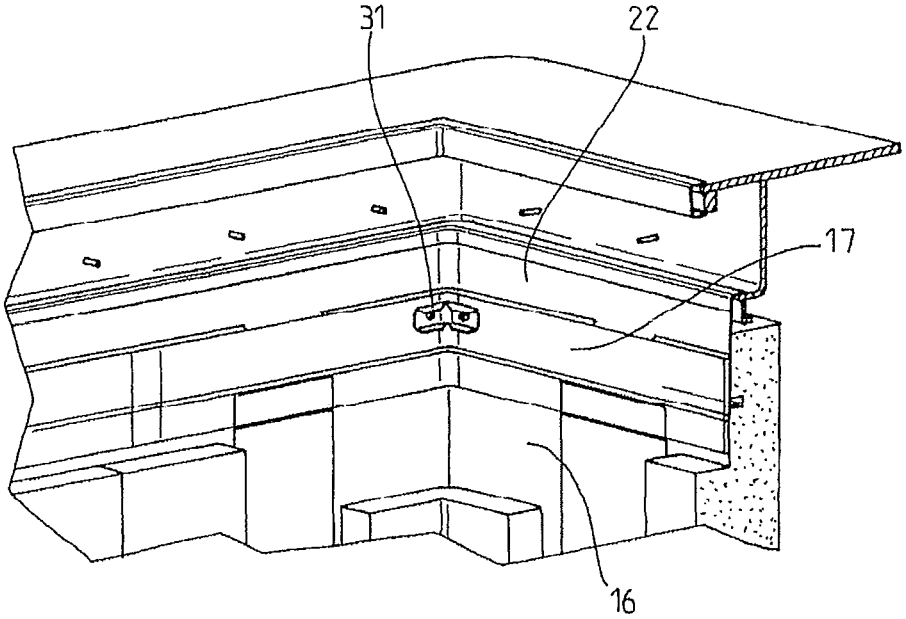
FIGS. 7 and 8 show a bracket in the corner of FIG. 6.
Figure 8:
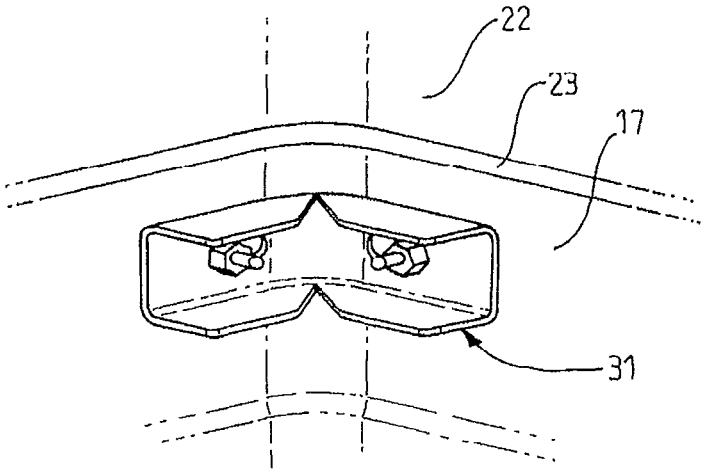

FIG. 7 is similar to FIG. 6 and shows a variant in which a bracket 31 is fixed in the angle, to keep the flexible sheet 17 in position. The reason for this is that bonding to a flat surface subjects the bonding of the angle zones to a resultant of thermomechanical forces perpendicular to the plane of bonding, which can cause the bonded join to peel apart and fail. Depending on the dimensions of the tank and the bonding characteristics, such a bracket 31 may or may not be necessary. FIG. 8 shows the bracket 31 and its fixing bolts in more detail.

Figure 9:
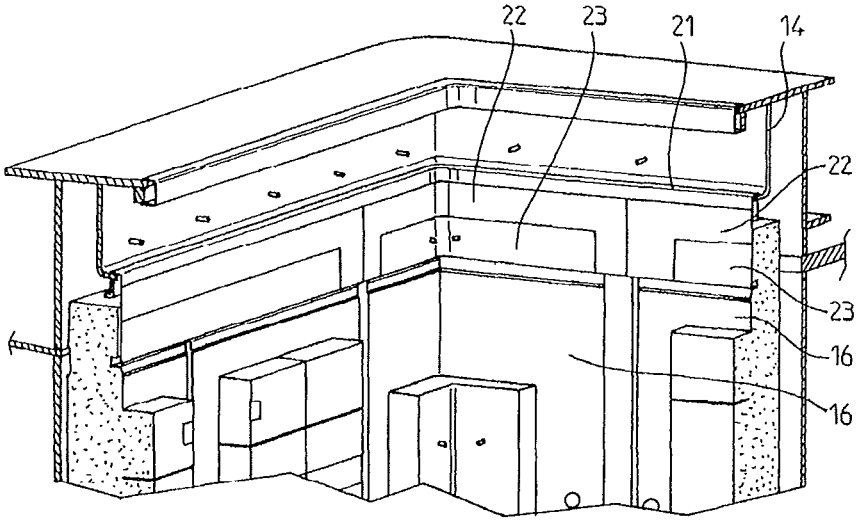
FIG. 9 is a view similar to FIG. 6, in which certain parts have been removed.
Figure 10:
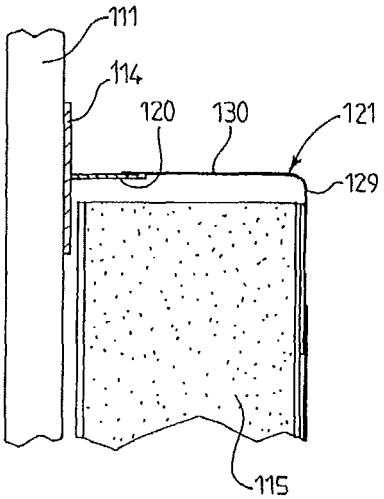
FIG. 10 is a cross section through a tank in another embodiment of the invention, at the termination zone of the secondary membrane.

FIG. 9 is similar to FIG. 6, but the flexible sheet 17 has been drawn back to show the components beneath it. It can be seen that the rigid sheet 23 takes the form, along the walls, of a planar strip. As in the prior art, such a planar strip is fabricated from two layers of fibreglass cloth, one on either side of an aluminium foil, soaked together in resin and hot-pressed while the resin cures. In the corner, the rigid sheet 23 takes the form of an L-shaped strip. This kind of non-planar strip may be made by curing the resin, with heat and pressure, on a mould with the desired shape. As a variant, in the corner, a flexible sheet 23 is used, which, because of its flexibility, is able to conform to a corner zone.

FIGS. 10 to 13 show a second embodiment of a tank according to the invention. The tank has several tank walls and is built into a loadbearing structure 111. The loadbearing structure 111 comprises vertical wall sections made of prestressed concrete. In this embodiment the loadbearing structure 111 and the tank form a land-based LNG container.

A metal plate 114 is fixed to the loadbearing structure 111. For example, the plate 114 may be positioned while the concrete is being poured. A metal plate 120 is welded to the plate 114 and extends horizontally.

Figure 11:
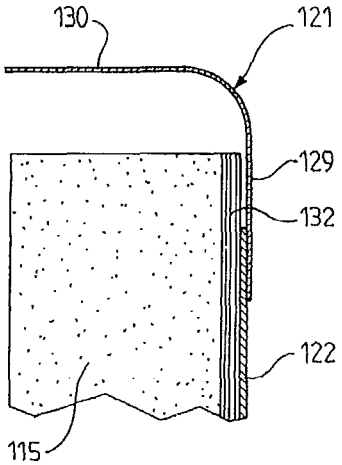
FIGS. 11 and 12 show details from FIG. 10.

In a similar way to the first embodiment, the primary thermally insulating barrier, the secondary impermeable barrier and the secondary thermally insulating barrier of the tank are essentially made up of multiple prefabricated panels fixed to the loadbearing structure 111. FIG. 11 in particular shows that each upper prefabricated panel comprises a layer 115 of insulating material covered by a plywood plate 132. The plate 132 is covered by a rigid sheet 116, except at a thinner upper edge, where the plate 132 has a recessed face 124.

A metal plate 122 is screwed to the panel 132, on the face 124, leaving an uncovered zone 133 adjacent to that part of the panel 132 which is covered by the sheet 116. The plate 122 is partly covered by a rigid sheet 123.

Figure 12:
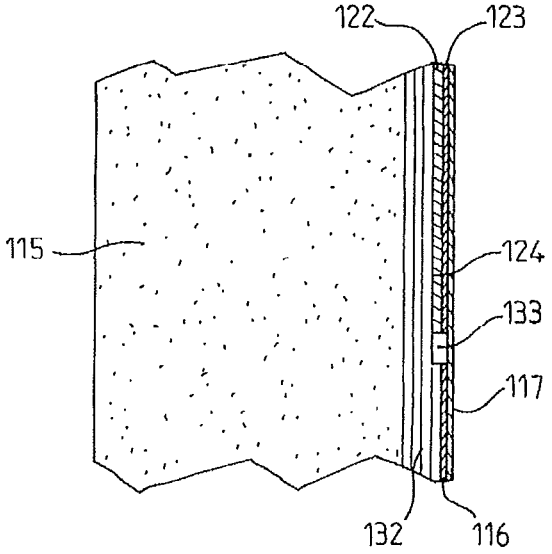

As shown in FIG. 12, a strip of flexible sheet 117 is bonded on the one hand to the sheet 116, and on the other hand to the sheet 123. Between the sheets 116 and 123 is an unbonded zone. It may be observed that this bonding is done on two parallel surfaces on which there are rigid sheets. The bonding can therefore be done easily, in an automated and reliable manner. The sheets 116 and 123 are preferably both in the same plane, thus making bonding even easier. As a variant, there is no sheet 123, and the strip of sheet 117 is bonded directly to the plate 122.

A metal angle bar 121 is welded partly to the plate 120 and partly to the plate 122. More specifically, the angle bar 121 has a horizontal wall 130 welded to the plate 120 and a vertical wall 129 welded to the plate 122.

Consequently the above structure makes it possible to connect the sheet 116 of the prefabricated panel impermeably to the loadbearing structure 111, by means of the flexible sheet 117, the rigid sheet 123, the plate 122, the angle bar 121, and the plates 120 and 114. The sheet 117 can be bonded in an automated and reliable manner. In a similar way, the angle bar 121 can be welded in an automated and reliable manner. The geometry of the angle bar 121 allows the position to be adjusted to coincide with the position of the plate 122.

Figure 13:
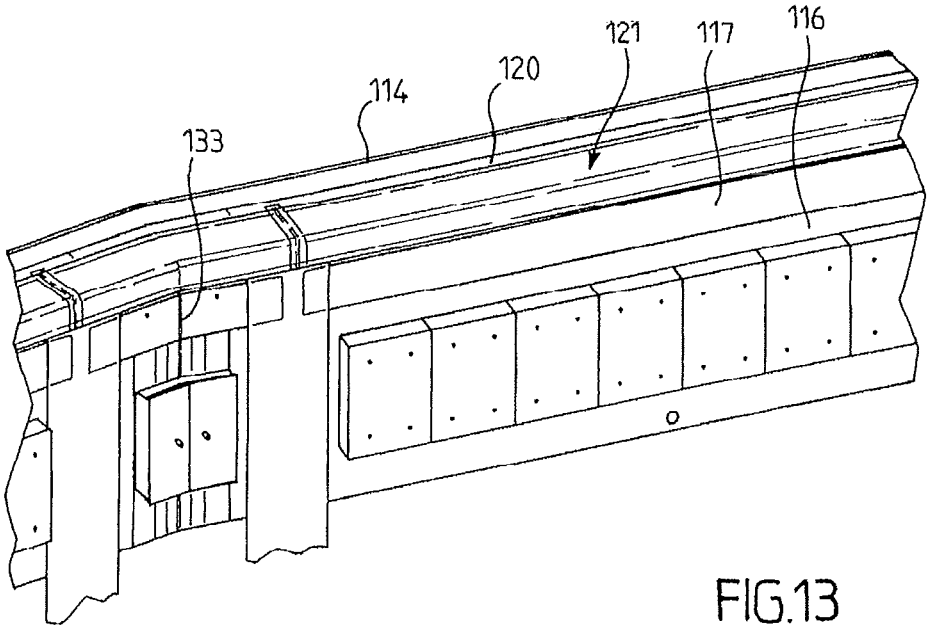
FIG. 13 is a perspective view of the termination zone of the secondary tank membrane shown in FIG. 10, in a corner.

FIG. 13 shows the termination zone of the secondary membrane in perspective. An angle zone 133 between two adjacent vertical walls can be seen. This angle is more open than in the case of the first embodiment so there is less risk of detachment by peeling. However, depending on the size of the tank and the peeling characteristics, a securing bracket may optionally be fitted, in a similar way to the bracket 31 in the first embodiment.

Although the invention has been described in relation to a number of specific embodiments, it will be obvious that it is not limited to these in any way and that it encompasses all technical equivalents of the means described and their combinations if these come within the scope of the invention.

In the two embodiments described above, the flexible sheet forms with in particular the plate 22 or 122 a connecting device which impermeably connects the sheet of a prefabricated panel to the loadbearing structure. One connecting device has been described in relation to a floating vessel and the other to a land-based container. Both connecting devices may however be used with a floating vessel or a land-based container.

The invention claimed is:

1. A liquefied natural gas container comprising;

a loadbearing structure (11, 111) and an impermeable and thermally insulated tank designed to contain liquefied natural gas, said tank comprising a plurality of tank walls fixed to said loadbearing structure, each tank wall having in succession, in a direction of thickness along the longitudinal direction of the tank wall, proceeding from an inside of said tank to an outside, a primary impermeable barrier, a primary thermally insulating barrier, a secondary impermeable barrier and a secondary thermally insulating barrier, said tank walls comprising at least one vertical wall, the secondary impermeable barrier located on said vertical wall comprising a first impermeable sheet (16, 116) at the top of said vertical wall and a connecting device which impermeably connects said first impermeable sheet (16, 116) to said loadbearing structure (11, 111), wherein said connecting device comprises a first metal plate (22, 122) parallel to said first impermeable sheet (16, 116) and a second impermeable sheet (17, 117), wherein the second impermeable sheet (17, 117) comprises a first portion which is bonded to said first impermeable sheet (16, 116) and a second portion which is connected to said first metal plate (22, 122), the first portion and the second portion of the second impermeable sheet (17, 117) being parallel.

2. The liquefied natural gas container according to claim 1, wherein said second impermeable sheet (17, 117) is flexible, and has an unbonded zone between the first impermeable sheet (16, 116) and the first metal plate (22, 122).

3. The liquefied natural gas container according to claim 1, in which a third impermeable sheet (23, 123) is bonded to said first metal plate (22, 122), and said second impermeable sheet (17, 117) is bonded to said third impermeable sheet (23, 123).

4. The liquefied natural gas container according to claim 1, wherein said first metal plate (22, 122) is welded to a metal component (21, 121) connected to the loadbearing structure (11, 111).

5. The liquefied natural gas container according to claim 4, wherein said metal component (21, 121) has a vertical part (29, 129) and a horizontal part (30, 130), the first metal plate (22, 122) is welded to the vertical part (29, 129), and the horizontal part (30, 130) is connected to the loadbearing structure (11, 111).

6. The liquefied natural gas container according to claim 1, wherein said first impermeable sheet (16, 116) is bonded to a layer of insulating material (15) or to a plate of plywood (132) forming part of the secondary thermally insulating barrier.

7. The liquefied natural gas container according to claim 1, wherein said loadbearing structure (11, 111) comprises vertical concrete wall sections configured to be installed on land.

8. The liquefied natural gas container according to claim 1, wherein said loadbearing structure (11, 111) is a double hull of a floating vessel.

9. The liquefied natural gas container according to claim 2, wherein a third impermeable sheet (23, 123) is bonded to said first metal plate (22, 122), said second impermeable sheet (17, 117) being bonded to said third impermeable sheet (23, 123).

10. The liquefied natural gas container according to claim 4, wherein the loadbearing structure (11, 111) includes:

a horizontal section (13), a vertical part (14) extending downwardly from the horizontal section (13), and a horizontal part (28) extending toward the metal component (21, 121).

11. The liquefied natural gas container according to claim 10, wherein the horizontal part (30) of the metal component (21, 121) includes:

an upper horizontal part (30) and a lower horizontal part (30) that extend from each end of the vertical part (29) in a direction away from the first metal plate (22), and the loadbearing structure (11,111) is connected to a lower side of the upper horizontal part (30), and wherein the gas container further comprises:

an L-shaped fixing bracket (20) arranged between a lower side of the horizontal part (28) of the loadbearing structure (11, 111) and an upper side of the lower horizontal part (30) of the metal component (21, 121).

12. The liquefied natural gas container according to claim 2, wherein said first impermeable sheet (16, 116) is bonded to a layer of insulating material (15) or to a plate of plywood (132) forming part of the secondary thermally insulating barrier.

13. The liquefied natural gas container according to claim 2, wherein the second impermeable sheet (17) is bonded to two sections of the first metal plate (22, 122) that join each other at an angle of approximately 90°, and the second impermeable sheet (17) is fixed in the angle by an angle bracket (31) bolted to the two sections of the first metal plate (22, 122).

14. A liquefied natural gas container comprising;

a loadbearing structure (11, 111) and an impermeable and thermally insulated tank designed to contain liquefied natural gas, said tank comprising a plurality of tank walls fixed to said loadbearing structure (11, 111), each tank wall having in succession, in a direction of thickness along the longitudinal direction of the tank wall, proceeding from an inside of said tank to an outside, a primary impermeable barrier, a primary thermally insulating barrier, a secondary impermeable barrier and a secondary thermally insulating barrier, said tank walls comprising at least one vertical wall, the secondary impermeable barrier located on said vertical wall comprising a first impermeable sheet (16, 116) at the top of said vertical wall and a connecting device which impermeably connects said first impermeable (16, 116) sheet to said loadbearing structure (11, 111), wherein said connecting device comprises a first metal plate (22, 122) parallel to said first impermeable sheet (16, 116), and a second impermeable sheet (17, 117) which is bonded to said first impermeable sheet (16, 116) and connected to the first metal plate (22, 122), wherein the container further comprises:

a metal component (21, 121) connected to the loadbearing structure (11,111), and having a vertical part (29, 129) and a horizontal part (30, 130), wherein the first metal plate (22,122) is welded to the vertical part (29,129), and the horizontal part (30, 130) is connected to the loadbearing structure (11, 111).

15. The liquefied natural gas container according to claim 14, wherein said second impermeable sheet is flexible, and has an unbonded zone between the first impermeable sheet (16, 116) and the first metal plate (22, 122).

16. The liquefied natural gas container according to claim 14, in which a third impermeable sheet (23, 123) is bonded to said first metal plate (22, 122), and said second impermeable sheet (17, 117) is bonded to said third impermeable sheet (23, 123).

17. The liquefied natural gas container according to claim 14, wherein the horizontal part (30) includes an upper horizontal part (30) and a lower horizontal part (30, 130) that extend from each end of the vertical part (29) in a direction away from the first metal plate (22).

18. A liquefied natural gas container comprising;

a loadbearing structure (11, 111) and an impermeable and thermally insulated tank designed to contain liquefied natural gas, said tank comprising a plurality of tank walls fixed to said loadbearing structure (11, 111), each tank wall having in succession, in a direction of thickness along the longitudinal direction of the tank wall, proceeding from an inside of said tank to an outside, a primary impermeable barrier, a primary thermally insulating barrier, a secondary impermeable barrier and a secondary thermally insulating barrier, said tank walls comprising at least one vertical wall, the secondary impermeable barrier located on said vertical wall comprising a first impermeable sheet (16, 116) at the top of said vertical wall and a connecting device which impermeably connects said first impermeable sheet (16, 116) to said loadbearing structure (11, 111), wherein said connecting device comprises a first metal plate (22, 122) having an upper portion extending parallel to said first impermeable sheet (16, 116), and a lower portion extending perpendicular to said first impermeable sheet (16, 116).

19. The liquefied natural gas container according to claim 18, wherein the secondary thermally insulating barrier comprises a prefabricated panel having a horizontal groove (25), and the lower portion of the first metal plate (22, 122) extends horizontally into the horizontal groove (25).

20. The liquefied natural gas container according to claim 18, wherein the container further comprises:

a metal component (21, 121) connected to the loadbearing structure (11, 111), and having a vertical part (29, 129) and a horizontal part (30, 130), wherein the first metal plate (22, 122) is welded to the vertical part (29,129), and the horizontal part (30, 130) is connected to the loadbearing structure (11, 111).

* * * * *